US005090737A

United States Patent [19]

Brammer et al.

[11] Patent Number: 5,090,737

[45] Date of Patent: Feb. 25, 1992

[54] DOWNHOLE ENERGIZABLE SEAL FOR TELESCOPING JOINTS

[75] Inventors: Norman Brammer, Fyvie Turiff, Scotland; Philippe C. Nobileau, Paris, France

[73] Assignee: ABB Vetco Gray Inc., Houston, Tex.

[21] Appl. No.: 647,603

[22] Filed: Jan. 29, 1991

[51] Int. Cl.[5] ..... F16L 35/00

[52] U.S. Cl. ..... 285/39; 285/338; 285/348; 166/82

[58] Field of Search ..... 285/39, 338, 346, 347, 285/348, 196; 166/124, 82, 387

[56] References Cited

U.S. PATENT DOCUMENTS

| | | | |
|---|---|---|---|
| Re. 23,748 | 12/1953 | Barber | 285/338 |
| 1,427,318 | 8/1922 | Payne | 285/39 |
| 2,546,348 | 3/1951 | Schuman . | |
| 2,633,201 | 3/1953 | Clark | 166/124 |
| 3,343,796 | 9/1967 | Trickey | 285/338 |
| 3,353,847 | 11/1967 | Brown . | |
| 3,432,175 | 3/1969 | Kawai | 285/338 |
| 3,797,864 | 3/1974 | Hynes et al. | 285/338 |
| 3,958,819 | 5/1976 | Tifft . | |
| 4,343,495 | 8/1982 | Nobileau et al. | 285/39 |
| 4,362,210 | 12/1982 | Green | 285/338 |
| 4,505,499 | 3/1985 | Uglow et al. | 285/338 |
| 4,911,480 | 3/1990 | Bridges et al. . | |
| 4,995,464 | 2/1991 | Watkins et al. | 285/39 |

FOREIGN PATENT DOCUMENTS

| | | | |
|---|---|---|---|
| 942796 | 2/1974 | Canada | 285/338 |

*Primary Examiner*—Eric K. Nicholson
*Attorney, Agent, or Firm*—James E. Bradley

[57] ABSTRACT

A telescoping joint for connecting casing between a subsea housing and a surface wellhead can be reenergized. The telescoping joint includes an upper conduit section and a lower conduit section that telescopingly insert within one another. A seal locates in an annular space between the two conduit sections. A torque nut secures between the upper and lower conduit sections. The torque nut bears against the seal. The torque nut has a slot in its bore that is engaged by a running tool lowered from a drilling vessel at the surface. The running tool rotates the torque nut to energize the seal. A ratcheting lock ring locks the telescoping joint against withdrawing movement.

14 Claims, 4 Drawing Sheets

DOWNHOLE ENERGIZABLE SEAL FOR TELESCOPING JOINTS

BACKGROUND OF THE INVENTION

1. Field of the Invention

This invention relates in general to offshore drilling equipment, and in particular to a telescoping joint for connecting between a subsea housing and a housing carried by a jackup drilling rig.

2. Description of the Prior Art

In one system used with offshore jackup drilling rigs, a string of casing in the well will be supported by a mudline hanger located in a subsea housing at the sea floor. A section of the casing will extend upward to a surface wellhead housing at the drilling rig. The surface wellhead housing will be located above the sea and below the rig floor. The distance from the subsea housing to the surface wellhead could be as much as 500 feet with a large jackup drilling rig.

Cement will be pumped down the casing string to flow up the annulus to cement the casing in the well. The level of cement will be below the mudline hanger. In one prior art system, the casing will be cut off at the surface wellhead. The blowout preventer will be removed, and a spear will be used to pull tension on the casing after cementing. Then slips will be inserted around the casing which engage the wellhead housing and grip the casing to hold the casing in tension. A packoff will be installed between the casing hanger and the wellhead housing. A disadvantage of this prior art system is that the blowout preventer must be removed while installing the slips and packoff. Also, the prior art system is time consuming and expensive.

There are other proposals. In U.S. patent application Ser. No. 466,985, Steven A. Cromar, et al, filed January 18, 1990 now U.S. Pat. No. 5,002,131, a mechanism is employed for applying tension to the casing, utilizing spring biased locking elements which engage grooves in the wellhead housing. This allows the length of the casing from the subsea housing to the surface wellhead to be adjusted.

Telescoping joints have been used in the past with floating drill rigs. These telescoping joints utilize inner and outer conduits that will slide with one another due to wave action. Seals located between the inner and outer conduits will slidingly seal during the wave movement. A jackup drilling rig will not utilize a telescoping joint of this type because it will not be floating during drilling operations.

SUMMARY OF THE INVENTION

In this invention, the casing extending between the subsea housing will have an upper conduit section and a lower conduit section. The lower end of the upper conduit section will telescopingly insert into the upper end of the lower conduit section. The upper and lower conduit sections will slide together until the upper conduit section is at a desired elevation.

A seal locates in the annular space between the upper and lower ends of the conduit sections. A torque nut is secured between the upper and lower conduit sections. The torque nut is threadingly secured so that rotating it will cause it to engage and deform the seal. The torque nut has splines in its bore. A running tool will be lowered from the drilling vessel through the upper conduit section and into engagement with the torque nut. The running tool rotates the torque nut to energize the seal after the telescoping joint sections have been placed in the proper position.

Also, the conduit sections have a locking means for locking the upper conduit section against upward movement. This includes a split ring that has threads that ratchet on threads of the other conduit section. During insertion, the ratcheting allows the upper and lower conduit sections to telescope to the desired elevation. The threads prevent the upper conduit section from moving upward due to internal pressure. The threads will allow the upper conduit section to be removed from the lower conduit section by rotation.

DETAILED DESCRIPTION OF THE INVENTION

Figure 1:
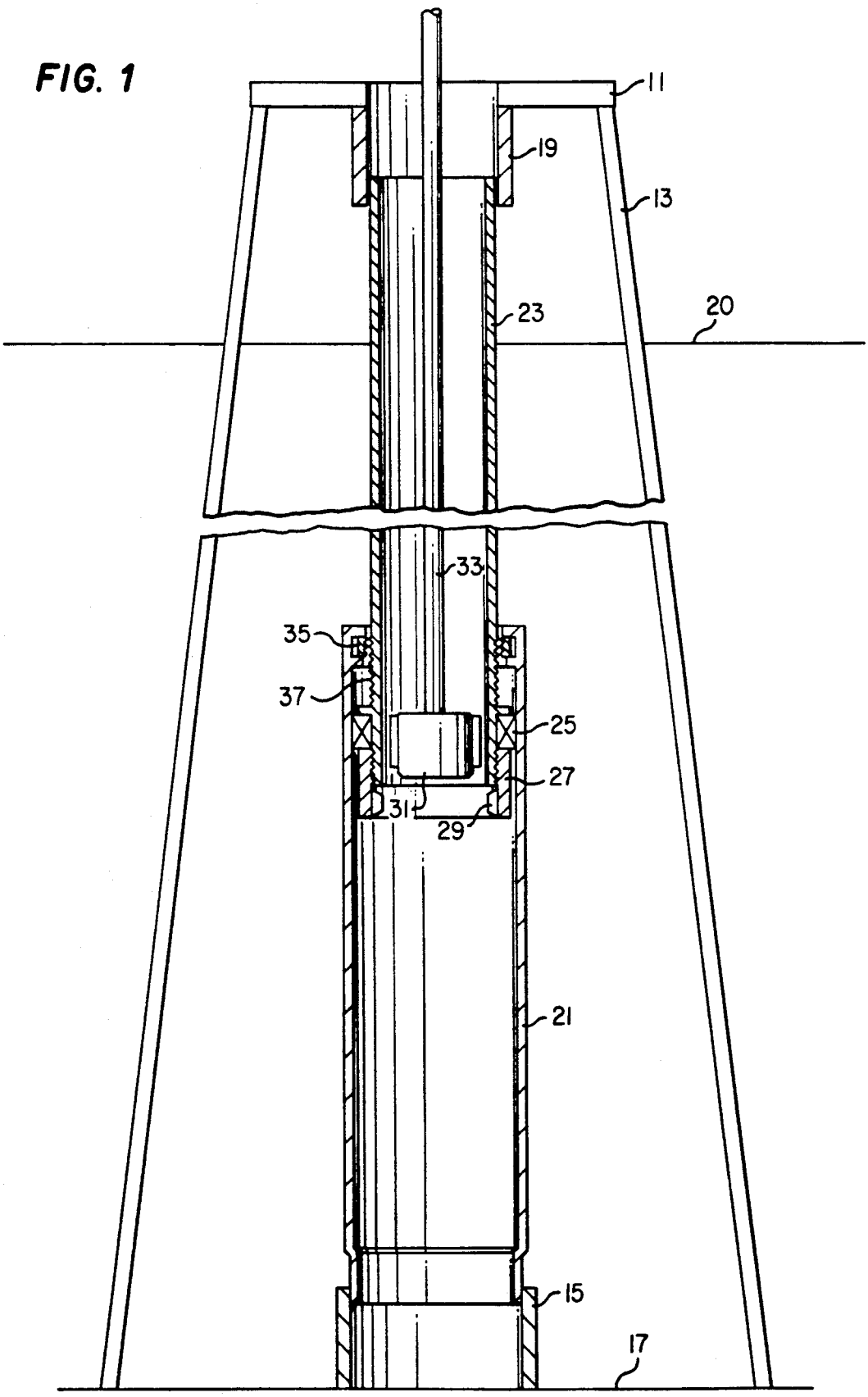
FIG. 1 is a schematic view illustrating a telescoping joint mounted in a string of casing suspended by a jackup drilling rig.

Referring to FIG. 1, the drawing shown is simplified. Drilling rig 11 is a jackup drilling rig of a type that has extensible legs. The legs 13 will support the drilling rig 11 on the sea floor 17. A subsea housing 15 will be located at the sea floor 17.

Figure 2A:
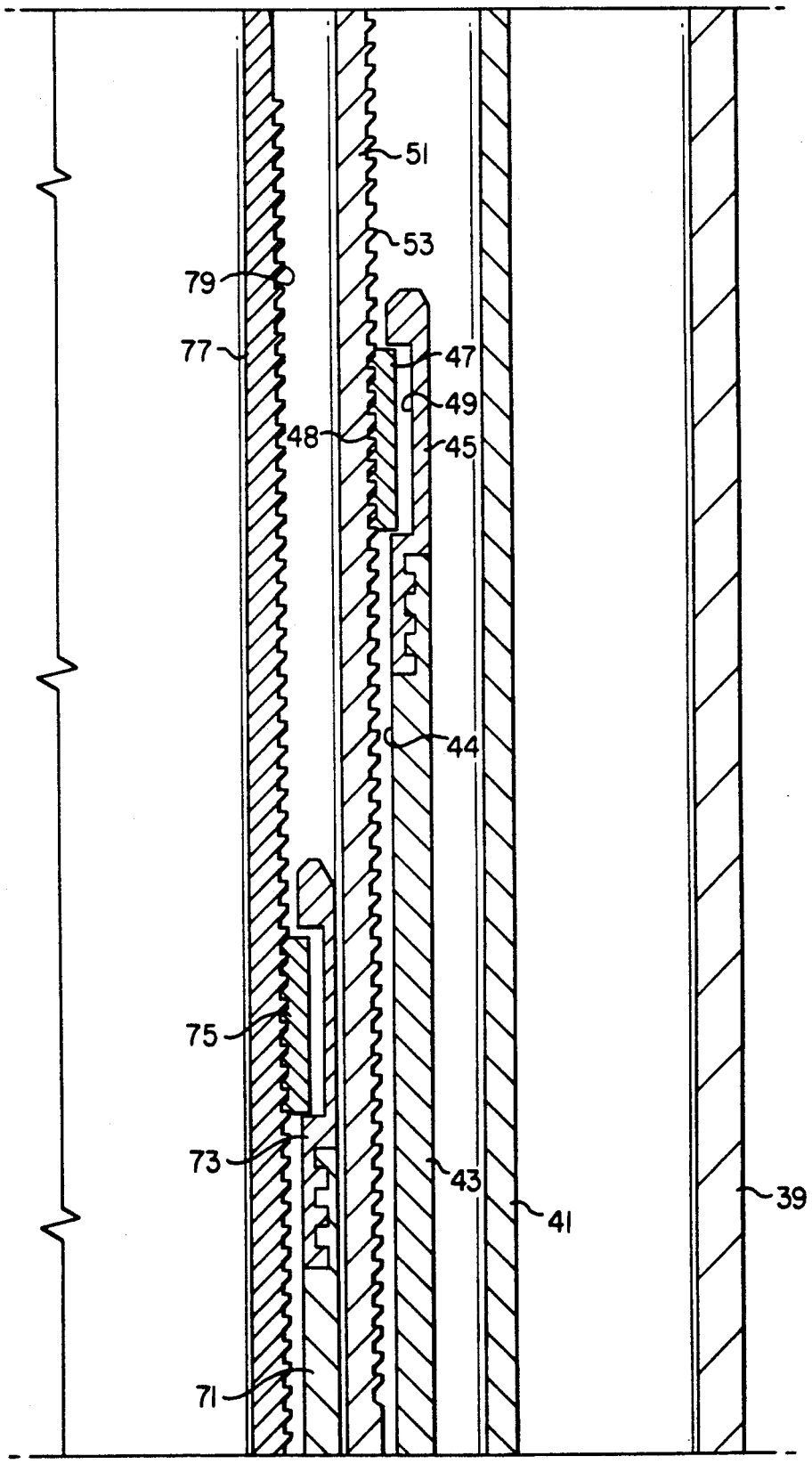
FIGS. 2A and 2B are enlarged sectional views illustrating a preferred embodiment of the telescoping joint of FIG. 1.
Figure 2B:
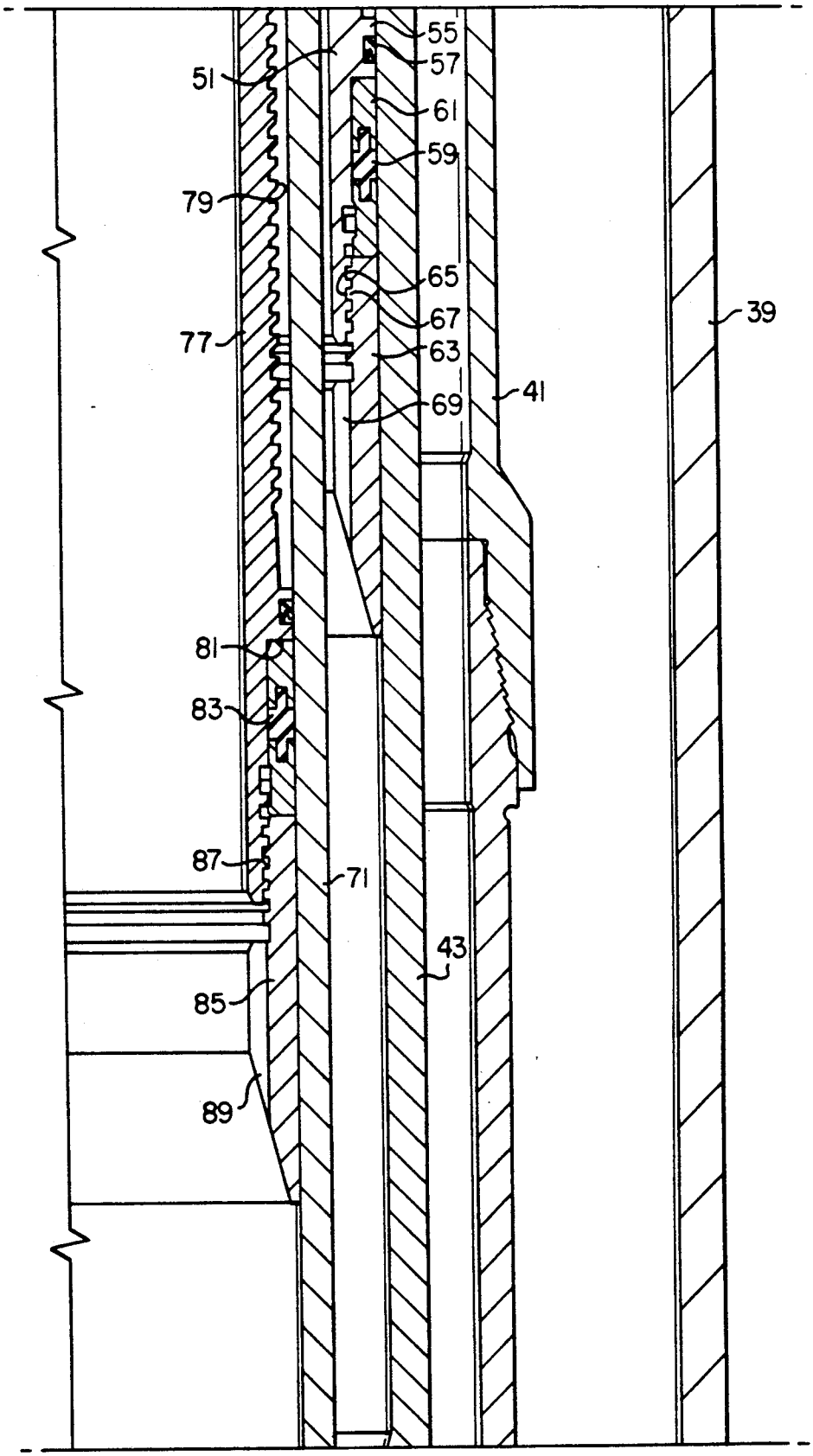

A surface wellhead housing 19 will be carried by the drilling rig 11 below the rig floor. Surface wellhead housing 19 will be located above the sea level 20. Two concentric large diameter conduits (not shown in FIG. 1) will extend between the subsea housing 15 and the wellhead housing 19. A single string of well casing 21, 23 is schematically illustrated, but in use as shown in FIGS. 2A and 2B, there will be normally two strings of concentric well casing located within two conductor pipes.

The well casing 21, 23 includes a lower conduit section 21 that extends upward from the subsea housing 15. The lower conduit section 21 will be supported by a mudline hanger (not shown) at the subsea housing 15, which supports the weight of casing (not shown) extending into the well, but does not pressure seal. An upper conduit section 23 will extend downward from the surface wellhead housing 19. The upper conduit section 23 will be sealed and supported by a casing hanger and packoff (not shown) at the surface wellhead housing 19.

In this invention, the upper conduit section 23 will insert telescopingly into the upper end of the lower conduit section 21. This allows the upper end of the upper conduit section 23 to land on a shoulder (not shown) in the wellhead housing 19. Once landed, the lower conduit section 21 and upper conduit section 23 will adjust to the distance from the subsea housing 15 to the surface housing 19. The drilling rig 11 does not move with wave action, consequently, once landed, lower and upper conduit sections 21, 23 will not move axially relative to each other.

A seal 25 seals the annular space between the upper conduit section 23 and the bore of the lower conduit section 21. Seal 25 will slidingly engage the bore of the lower conduit section 21 as the upper conduit section 23 inserts into the lower conduit section 21. It may not provide a sufficiently tight seal however, once the proper position of the conduit sections 21, 23 has been achieved.

A torque nut 27 allows the seal 25 to be further energized once the conduit sections 21, 23 have reached their proper axial positions relative to each other. Torque nut 27 is threadingly secured to the upper conduit section 23. Torque nut 27 has an upper end that bears against the lower end of seal 25. Nut 27 has a key or spline 29 located in its bore.

A running tool 31 will be lowered on drill pipe 33 until reaching torque nut 27. The running tool 31 will engage the key 29. Rotating the drill pipe 33 will cause the torque nut 27 to tighten against the seal 25. This further energizes the seal 25 to prevent leakage.

In addition, a retaining ring 35 will be employed to lock the axial position of the upper conduit section 23 relative to the lower conduit section 21. Retaining ring 35 is a split ring that engages threads 37 on the exterior of the upper conduit section 23. The retaining ring 35 will ratchet over the threads 37 as the upper conduit section 23 inserts into the lower conduit section 21. The inclined flanks of the threads prevent the upper conduit section 23 from moving upward relative to the lower conduit section 21. This locking system serves to prevent the upper conduit section 23 from moving upward due to high internal pressure.

FIGS. 2A, 2B, 3 and 4 show a detailed embodiment of portions of the system of FIG. 1. To avoid confusion, different numerals will be used for the elements in FIGS. 2A, 2B, 3 and 4 than in FIG. 1. In the preferred embodiment, a 30 inch diameter outer conduit 39 will extend between the subsea housing 15 and the wellhead housing 19 (FIG. 1). In addition, a 20 inch diameter conduit 41 will extend between the subsea housing 15 and the wellhead housing 19. Neither of the conduits 39, 41 will have a telescoping joint, as these members will rigidly attach and support the wellhead housing 19 at a fixed elevation above the subsea housing 15 (FIG. 1).

A lower casing section 43 will be supported in the subsea housing 15. The lower casing section 43 extends upward. The lower casing section 43 has a bore 44, the upper end of which will be machined to provide a sealing surface.

A support ring 45 mounts to the upper end of the lower casing section 43. A retaining ring 47 locates in an annular recess in the support ring 45. Retaining ring 47 is a split ring. A key (not shown) will locate in the split of the retaining ring 47 and in the support ring 45 for preventing rotation of the retaining ring 47 relative to the support ring 45. The recess 49 allows the retaining ring 47 to expand outward so that its inner diameter can expand to substantially the same inner diameter as the bore 44. Retaining ring 47 has a set of ratchet threads 48 on its inner diameter.

An upper casing section 51 will extend downward from the drill rig 11 (FIG. 1). The upper casing section 51 will have a casing hanger (not shown) on its upper end that will land in the wellhead housing 19 (FIG. 1). An annular seal (not shown) will seal the casing hanger in the wellhead housing 19.

Upper casing section 51 will insert into the bore 44 of the lower casing section 43. A set of locking threads 53 are formed on the lower end of upper casing section 51. Locking threads 53 are helical and of a 25 single start type. Also, each locking thread 53 has an inclined downward facing flank 53*a*, shown in FIG. 4. Each locking thread 53 has a upward facing flank 53*b* that is perpendicular to the axis of the upper conduit section 51.

Figure 3:
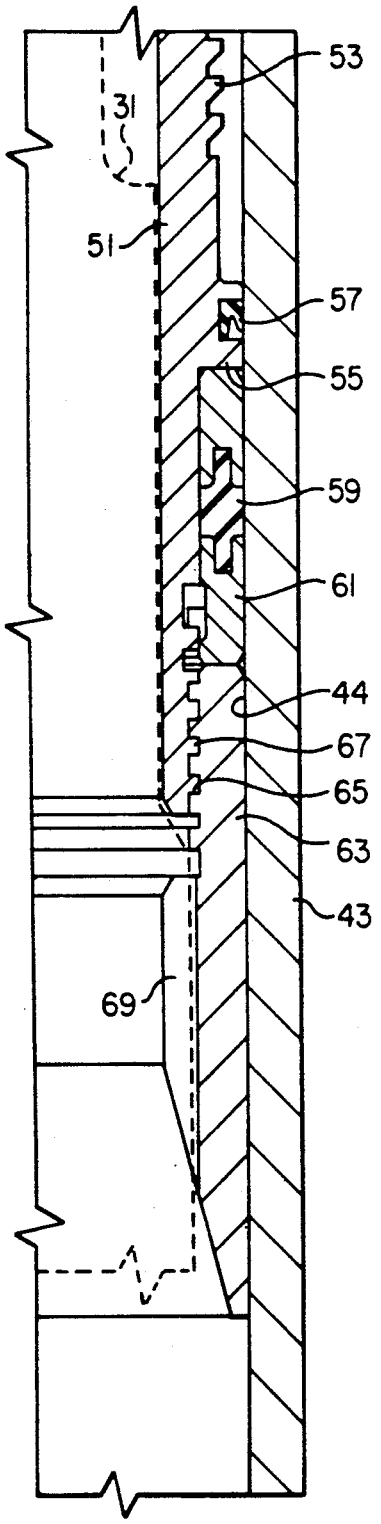
FIG. 3 is a further enlarged view of a portion of the telescoping joint illustrated in FIGS. 2A and 2B.
Figure 4:
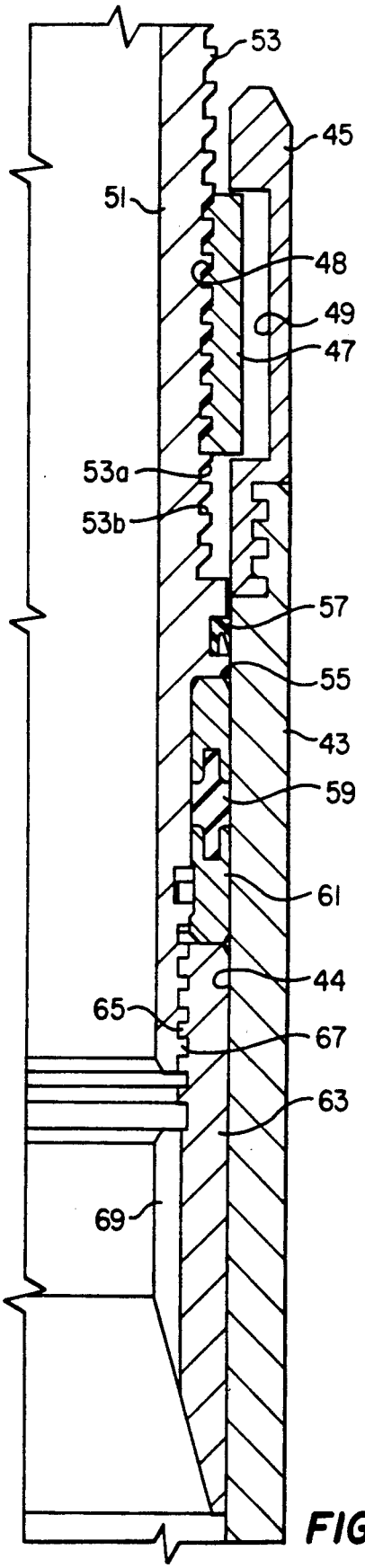
FIG. 4 is a sectional, enlarged view of the telescoping joint of FIGS. 2A and 2B, with the ends shown being inserted into each other.

The ratchet threads 48 of the retaining ring 47 have the same configuration, pitch and size, with an inclined upward facing flank that mates with the flank 53*a*, and a downward facing perpendicular flank that mates with the flank 53*b*. Ratchet threads 48 will engage the locking threads 53. The retaining ring 47 will ratchet on the locking threads 53 when the upper casing section 51 inserts into the lower casing section 43. The configuration of the flanks of the threads 48, 53 allows ratcheting action to occur during downward movement. FIG. 4 shows the upper conduit section 51 initially entering the lower conduit section 43, while FIGS. 2B and 3 show the upper conduit section 51 more deeply inserted into the lower conduit section 43.

Upward pull on the upper casing 51, however, will not result in ratcheting action. The perpendicular upper flank 53*b* engaging a similar perpendicular flank of the ratchet threads 48 will prevent any upward movement of the upper casing section 51 due to straight upward pulls or internal pressure. Rotating the upper casing section 51 in the proper direction, however, will unscrew the locking threads 53 from the retaining ring 47. This allows the upper casing section 51 to be unscrewed from the lower casing section 43 and pulled to the surface.

Referring to FIG. 2B, a stop shoulder 55 locates below the locking threads 53 on the exterior of the upper casing section 51. Stop shoulder 55 is an annular band, the outer diameter of which is slightly less than the inner diameter of bore 44 of lower casing section 43. A seal 57 locates in the stop shoulder 55 for sealing against the bore 44.

An adjustable seal 59 locates below stop shoulder 55. Seal 59 includes upper and lower compression rings 61 of metal, with the elastomeric portion of seal 59 being located between. Seal 59 will also slidingly engage the bore 44 of the lower casing section 43 when the upper casing section 51 inserts into the lower casing section 43.

A torque nut 63 mounts to the upper casing section 51 at its lower end. Torque nut 63 has an upper end that bears against the lower compression ring 61 of seal 59. Torque nut 63 is a tubular member, having threads 65 in the interior. Threads 65 engage a set of threads 67 located on the exterior of the upper casing section 51. The threads 67 extend below a smooth cylindrical sealing surface where the seal 59 locates.

Torque nut 63 has at least one internal engaging member, preferably a spline or slot 69 located in its interior. A lower portion of torque nut 63 extends below the lower end of upper casing section 51. This exposes spline 69 to the bore of the upper casing section 51. Spline 69 has a vertical shoulder for engagement by running tool 31 (FIG. 3).

Installing the lower casing section 43 and upper casing section 51 will be as described in connection with the description of FIG. 1. Once the upper casing section 51 has located at its proper elevation, the retaining ring 47 will prevent any upward movement. A pressure test will be made. Should leakage occur, a running tool 31 (FIGS. 1 and 3) will be lowered into engagement with torque nut 63. The running tool 31 will be rotated by drill pipe 33 (FIG. 1). This rotation causes the torque nut 63 to tighten against the seal 59. The seal 59 will deform and tightly seal against the bore 44 and against the exterior of the upper casing section 51.

The preferred embodiment also has a similar smaller diameter casing string 71, 77 located in the lower casing section 43 and upper casing section 51. This smaller diameter casing string 71, 77 will also be supported and sealed in the same manner. The schematic representation of FIG. 1 could represent either the casing sections 43, 51, or the casing sections 71, 77. The casing string 71, 77 includes a lower casing section 71 which has a support ring 73 on its upper end. A retaining ring 75 locates in the support ring 73. The upper casing section 77 lands in the wellhead housing 19 (FIG. 1). The lower end of upper casing section 77 will insert into the upper end of the lower casing section 71. Locking threads 79 on the exterior of upper casing section 77 will be engaged by the retaining ring 75.

A stop shoulder 81 will serve as a backup for an annular seal 83. Torque nut 85 will compress the seal 83 against the stop shoulder 81. Torque nut 85 secures by threads 87 to the lower end of upper casing section 77. Splines 89 locate in the interior of torque nut 85. A running tool (not shown) will engage the splines 89 to rotate the torque nut 85.

The invention has significant advantages. The telescoping joint allows one to achieve the desired distance for casing strings extending between a subsea housing and a surface wellhead. The torque nut allows the seal to be energized after the telescoping joint has been moved to its desired dimension, assuring sealing. The ratcheting retaining ring prevents the upper conduit section from moving upward relative to the lower conduit section due to high pressure.

While the invention has been shown in only one of its forms, it should be apparent to those skilled in the art that it is not so limited, but is susceptible to various changes without departing from the scope of the invention.

We claim:

1. An apparatus for connecting a subsea well housing to surface well housing supported by a drilling rig above sea level, comprising in combination:

a lower conduit section extending upward from and above the subsea well housing and having an open upper end;

an upper conduit section extending downward from the surface well housing, the upper conduit section having a lower end that extends telescopingly into the upper end of the lower conduit section to a selected amount to land an upper end of the upper conduit section in the surface well housing;

a seal located on the exterior of the upper conduit section at the lower end for sealing against the interior of the lower conduit section; and a torque nut secured by threads to the lower end of the upper conduit section, the torque nut having an upper end which engages the seal, the torque nut having a bore containing at least one vertical shoulder for rotating the torque nut with a running tool lowered through the upper conduit section, to selectively tighten the torque nut against the seal.

2. The apparatus according to claim 1 further comprising a downward facing shoulder on the exterior of the upper conduit section, the seal abutting against the shoulder.

3. The apparatus according to claim 1 wherein the threads comprise a thread set located on the exterior of the lower end of the upper conduit section and a mating thread set located in the interior of the torque nut.

4. The apparatus according to claim 1 wherein the threads comprise a thread set located on the exterior of the lower end of the upper conduit section and a mating thread set located in the interior of the torque nut, and wherein the torque nut has a lower portion extending below the lower end of the upper conduit section, the vertical shoulder being located in the lower portion.

5. An apparatus for connecting a subsea well to a drilling rig at the surface, comprising in combination:

a lower conduit section extending upward from the subsea well and having an open upper end;

an upper conduit section extending downward from the drilling rig, the upper conduit section having a lower end that telescopingly inserts with the upper end of the lower conduit section to a selected amount to place an upper end of the upper conduit section at a desired elevation;

a seal located in an annular space between the upper and lower ends of the lower and upper conduit sections, respectively;

locking means located in the annular space between the upper and lower ends of the lower and upper conduit sections, respectively, for allowing inward telescoping movement as the upper and lower conduit sections insert within one another, but for preventing outward telescoping movement, to prevent internal pressure in the upper and lower conduit sections from pushing the upper conduit section upward; and a torque nut secured between the upper and lower ends of the lower and upper conduit sections, respectively, the torque nut having an upper end which engages the seal, the torque nut having a bore containing at least one engaging member for rotating the torque nut with a running tool lowered through the upper conduit section, to selectively tighten the torque nut against the seal.

6. The apparatus according to claim 5 wherein the locking means comprises:

a set of locking threads located in said annular space; and a split ring located in said annular space and having a set of threads, the split ring being carried by one of the conduit sections for engaging the locking threads in ratcheting action as the upper and lower conduit sections insert within one another.

7. The apparatus according to claim 5 wherein the engaging member is a vertical shoulder.

8. The apparatus according to claim 5 wherein the torque nut is secured between the upper and lower ends of the lower and upper conduit sections, respectively, by threads.

9. An apparatus for connecting a subsea well housing to a surface well housing supported by a drilling rig above sea level, comprising in combination:

a lower conduit section extending upward from the subsea well housing and having an open upper end;

an upper conduit section extending downward from the surface well housing, the upper conduit section having a lower end that extends telescopingly into the upper end of the lower conduit section to a selected amount to land an upper end of the upper conduit section in the surface well housing;

a set of locking threads formed on the exterior of the lower end of the upper conduit section;

a split ring having a set of ratchet threads, the split ring being carried in the interior of the lower conduit section adjacent the upper end of the lower conduit section, for ratcheting engagement with the locking threads as the upper conduit section is lowered into the lower conduit section, the split ring preventing pressure in the upper and lower conduit sections from pushing the upper conduit section upward;

a stop shoulder on the exterior of the upper conduit section below the locking threads;

a seal located on the exterior of the upper conduit section having an upper end in contact with the stop shoulder for sealing against the interior of the lower conduit section;

a set of torque nut threads located on the exterior of the lower end of the upper conduit section below the seal;

a torque nut having a bore containing internal threads which engage the torque nut threads, securing the torque nut to the lower end of the upper conduit section below the seal, the torque nut having an upper end which engages the seal, the torque nut having a vertical shoulder located in the bore below the internal threads for rotating the torque nut with a running tool lowered through the upper conduit section, to selectively tighten the torque nut to push the seal against the stop shoulder.

10. The apparatus according to claim 9 wherein the split ring and locking threads allow the upper conduit section to be moved upward relative to the lower conduit section by rotating the upper conduit section relative to the lower conduit section.

11. A method for connecting a subsea well housing to a surface well housing supported above sea level by a drilling rig, comprising in combination:

running a lower conduit section upward from the subsea well housing to a point with an upper end located below the drilling rig;

lowering an upper conduit section downward from the drilling rig and inserting the upper and lower conduit sections telescopingly together until an upper end of the upper conduit section lands in the surface well housing;

providing a seal in an annular space between the lower and upper conduit sections;

positioning a torque nut in said annular space in engagement with the seal;

lowering a running tool from the drilling rig through the upper conduit section into engagement with the torque nut; and rotating the torque nut to tighten the seal between the upper and lower conduit sections.

12. The method according to claim 11 further comprising preventing the upper and lower conduit sections from moving axially apart from each other during said telescoping movement.

13. A method for connecting a subsea well housing to a surface well housing supported by a drilling rig above sea level, comprising in combination:

running a lower conduit section upward from the subsea well housing to a point with an upper end located below the drilling rig;

lowering an upper conduit section downward from the surface well housing and inserting the upper and lower conduit sections telescopingly together;

providing a locking member in an annular space between the upper and lower conduit sections;

preventing upward movement of the upper conduit section relative to the lower conduit section with the locking member during insertion of the upper conduit section, but allowing insertion of the upper and lower conduit sections until an upper end of the upper conduit section lands in the surface well housing;

providing a seal in the annular space between the upper and lower conduit sections;

positioning a torque nut in said annular space in engagement with the seal;

lowering a running tool from the drilling rig through the upper conduit section into engagement with the torque nut after the selected amount of insertion of the upper and lower conduit sections has been reached; and rotating the torque nut to tighten the seal between the upper and lower conduit sections.

14. The method according to claim 13 further comprising removing the upper conduit section from the lower conduit section by rotating the upper conduit section relative to the lower conduit section.

* * * * *